United States Patent [19]

Caplis et al.

[11] Patent Number: 4,462,747

[45] Date of Patent: Jul. 31, 1984

[54] MATERIAL CONVEYOR FOR USE WITH A BACKHOE

[75] Inventors: Thomas J. Caplis; Carrol E. Peck; John C. Felton, all of Missoula County, Mont.

[73] Assignee: Felco, Inc., Missoula, Mont.

[21] Appl. No.: 346,900

[22] Filed: Feb. 8, 1982

[51] Int. Cl.[3] ..... B65G 41/00

[52] U.S. Cl. ..... 414/567; 198/311; 405/179; 414/501; 414/786

[58] Field of Search ..... 414/565, 566, 567, 786, 414/501, 502; 37/142.5; 405/179; 198/311

[56] References Cited

U.S. PATENT DOCUMENTS

| | | | |
|---|---|---|---|
| 745,137 | 11/1903 | Beard | 414/565 |
| 1,481,211 | 1/1924 | Keech et al. | 414/565 |
| 3,241,693 | 3/1966 | Ströker | 414/565 |
| 3,547,287 | 12/1970 | Cunningham, Sr. | 198/311 X |
| 3,561,627 | 2/1971 | Fisher | 414/501 |
| 3,739,929 | 6/1973 | McRobert | 414/420 |
| 3,998,341 | 12/1976 | Wolf | 414/565 |
| 4,379,672 | 4/1983 | Hunter | 414/565 |

*Primary Examiner*—Robert J. Spar
*Assistant Examiner*—Janice Krizek
*Attorney, Agent, or Firm*—Seed and Berry

[57] ABSTRACT

A conveyor assembly for a backhoe is disclosed which enables the operator of the backhoe to convey material from the rear of the backhoe to the front thereof for discharge directly into the bucket of the backhoe on command, eliminating the need for rotation of the turret of the backhoe. The conveyor assembly extends longitudinally through the support frame of the backhoe unit. A hopper filled with material to be conveyed is located at the rear end of the conveyor. The power driven conveyor is controlled from the cab of the backhoe.

8 Claims, 6 Drawing Figures

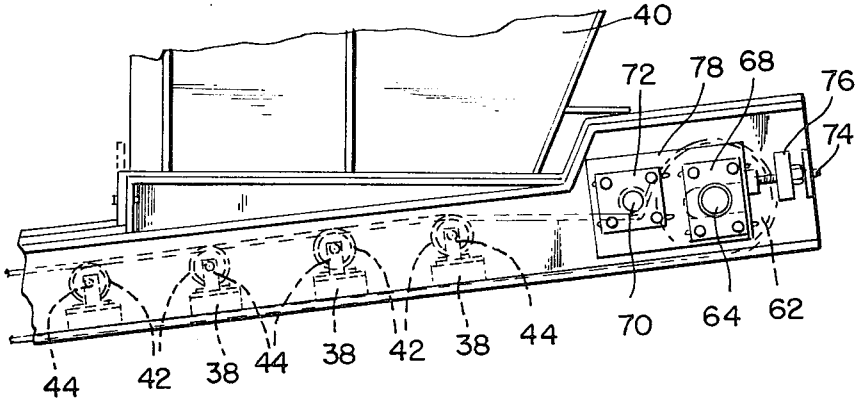
FIG. 3
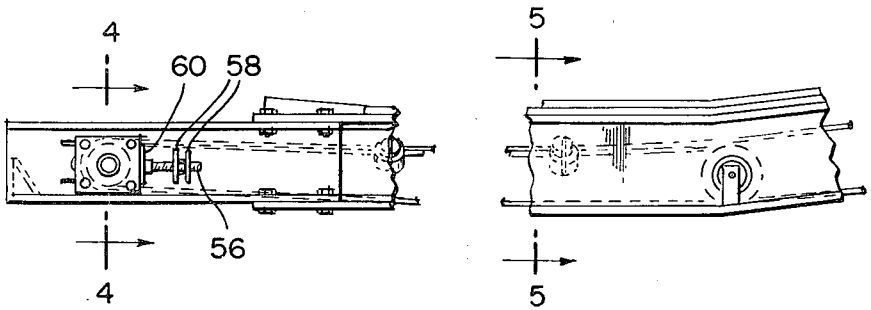
FIG. 4
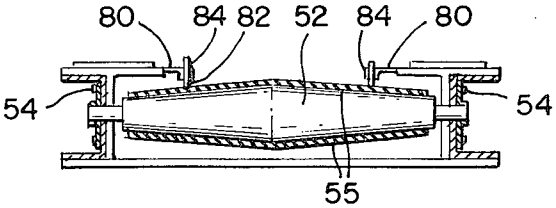
FIG. 5
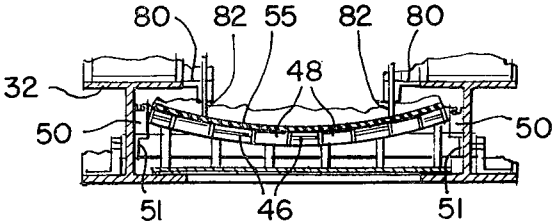
FIG. 6
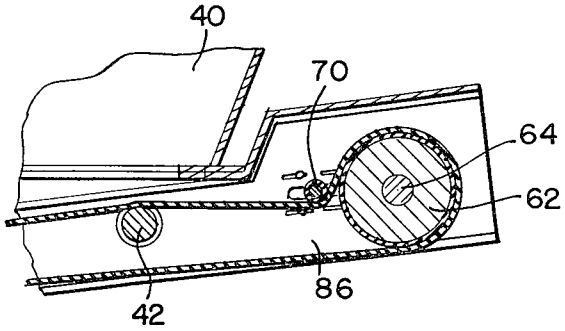

MATERIAL CONVEYOR FOR USE WITH A BACKHOE

TECHNICAL FIELD

This invention relates to a backhoe unit modified to include a conveyor assembly for conveying material from the rear end of the backhoe unit to the front end thereof for discharge directly into the bucket of the backhoe.

BACKGROUND ART

It is generally necessary to provide a layer of bedding (gravel) in trenches where pipe is to be laid, in drainage ditches, or for other types of construction work. The trenches are provided with a layer of bedding using the same backhoe used to dig the trench. This has generally been accomplished by providing a hopper filled with gravel positioned on the ground behind the backhoe. When the backhoe operator needs bedding, he must pivot the articulating arm and bucket of the backhoe about 180 degrees, dip bedding gravel out of the bedding box with the bucket, and then pivot the arm and bucket back to its original position to discharge the bedding into the trench. This is not only time-consuming, but such a backhoe unit is limited to areas where there is sufficient room for the unit to rotate.

A device is known for modifying a backhoe for unloading the bucket of the backhoe in a way to eliminate having to rotate the turret of the backhoe during unloading. U.S. Pat. No. 3,998,341 describes providing the jib of a backhoe with transverse flights. When the bucket of the backhoe is filled with a load of dirt, it is moved up against the jib to allow the flights of the conveyor to sweep the dirt out of the bucket onto a continuous conveyor which moves the material to the rear of the backhoe.

U.S. Pat. No. 1,481,211 describes a mechanical shovel employing an endless conveyor for conveying the shoveled material rearwardly for deposit on a tram.

U.S. Pat. No. 745,137 discloses an excavator which includes articulating arms also functioning as a chute. When the bucket of the excavator picks up a load of material and is moved upwardly, the material in the bucket slides down the chute formed by the articulating arms into a hopper.

U.S. Pat. Nos. 3,561,627 and 3,739,929 disclose forklift vehicles modified to load, transport, and unload bins used to carry fruit. The bins are conveyed to the rear of the forklift on a conveyor which extends longitudinally through the body of the forklift.

DISCLOSURE OF INVENTION

This invention is directed to a backhoe modified to include a conveyor for conveying material, such as gravel, from the rear end of the backhoe into the bucket of the backhoe without having to rotate the turret of the backhoe. The backhoe is provided with a conveyor assembly which extends longitudinally of the backhoe for conveying material from behind the backhoe forward to the front thereof for discharge directly into the bucket of the backhoe. The conveyor assembly includes a hopper mounted adjacent the rear end thereof discharging material placed therein directly onto a conveyor belt of the conveyor assembly. The conveyor belt is driven on command by the operator of the backhoe to discharge material on the conveyor belt directly into the bucket of the backhoe for placement as desired. Use of a backhoe modified as described hereafter enables faster operation, eliminates the need for rotating the turret of the backhoe for loading bedding into a trench, substantially eliminates spillage and wasted bedding, enables the backhoe to work in places where it cannot be rotated about its turret, and eliminates the need for the operator of the backhoe to have to wait for a third person to provide material for his use.

BRIEF DESCRIPTION OF THE DRAWINGS

FIG. 3 is a side elevational view of the conveyor assembly of FIG. 2;

FIG. 4 is a vertical cross-sectional view along section line 4—4 of FIG. 3 illustrating the front pulley of the conveyor assembly;

FIG. 5 is a cross-section along section line 5—5 of FIG. 3 illustrating the idler supports for the conveyor belt; and FIG. 6 is a partial vertical cross-sectional view of the rear end of the conveyor illustrating the drive pulley and tensioning roll for the conveyor.

BEST MODE FOR CARRYING OUT THE INVENTION

Figure 1:
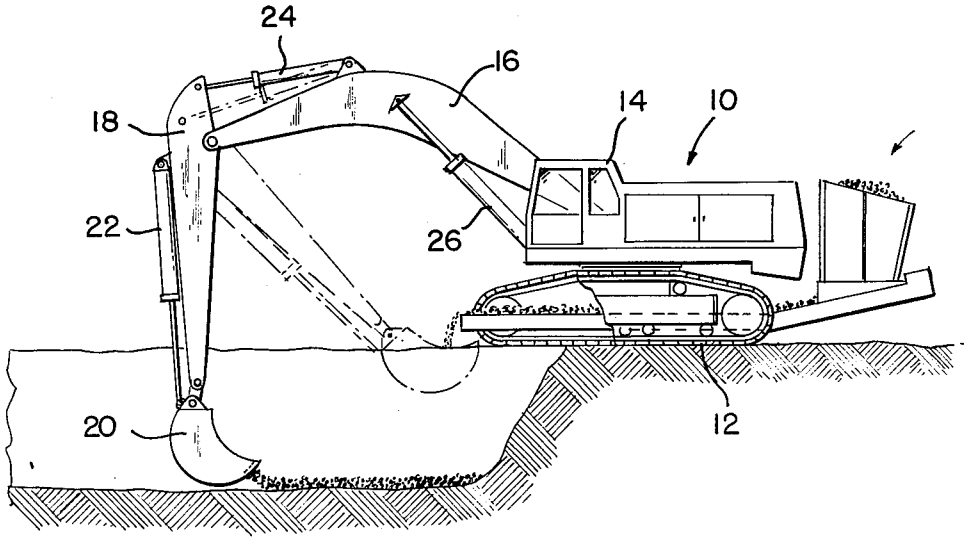
FIG. 1 is a side elevational view of a backhoe modified to include a conveyor assembly for conveying bedding from the hopper mounted on the rear of the conveyor assembly to the bucket of the backhoe on command of the operator.

FIG. 1 illustrates a conventional backhoe unit which includes a rotatable support frame 10 mounted to an undercarriage to which crawler tracks 12 are attached for mobility. A cab 14 is supported on the frame 10. A pair of articulating arms 16 and 18 extend from a pivotal connection to the support frame (not shown). A bucket 20 is pivotally secured to the end of arm 18, as illustrated. Movement of the bucket 20 and positioning of the articulating arms is controlled by hydraulic cylinders 22, 24 and 26.

A conveyor assembly 30 is secured to the backhoe unit so that the length of the conveyor extends between the crawler tracks 12 of the backhoe unit. The conveyor assembly includes spaced, parallel steel I-beam supports 32 held in spaced relation by transverse supports 34 welded at spaced intervals along the length of the conveyor. The spacing of the I-beams is such as to permit the conveyor to extend between the crawler tracks of the backhoe unit. The steel beams are secured to the undercarriage of the backhoe unit as necessary. Steel plate reinforcing strips 36 may be welded to the top surface of the I-beam supports 32 if necessary.

Brackets 38 are mounted at spaced intervals along the inner side of the web of the respective I-beam 32 beneath hopper 40 to support idler rolls. Referring to FIG. 3, a plurality of cylindrical steel idler rolls 42 are journaled for rotation to supports 44 directly beneath the hopper 40.

Downstream from the idler rolls 42, a series of cable-type impact idler rolls are located, as illustrated in cross-section in FIG. 5. Referring to FIG. 5, each of the cable-mounted idler rolls includes a cable 46 about which are molded one-piece rubber units 48. The cable is attached at each end to a hanger 50 bolted to a bracket 51 welded to the inside of the main body of the I-beam 32.

At the discharge end of the conveyor, a front pulley 52 is mounted as illustrated in cross-section in FIG. 4. This pulley has a crowned center and is journaled for rotation through openings in the I-beams 32 to flange block bearings 54. The front pulley can be adjusted horizontally to tension or loosen the conveyor belt 55 trained about it by means of the screw adjustment 56 which is threaded through flanges 58 secured to I-beam 32 as shown in FIG. 3 or by means of an adjustable length frame. The foot 60 of the threaded shaft 56 is secured to the flange bearing 54 for adjustment horizontally as the threaded shaft is screwed one way or the other. Alternatively, the length of the conveyor can be adjusted by adjusting the length of the frame. To do this, a piece of the main frame of the conveyor, having pulley 52 associated therewith, is welded or otherwise secured to two parallel supports which are adapted to slide along the inside of the I-beams 32. The length of the conveyor is adjusted by securing the parallel supports to the I-beams 32 at any desired location.

Figure 2:
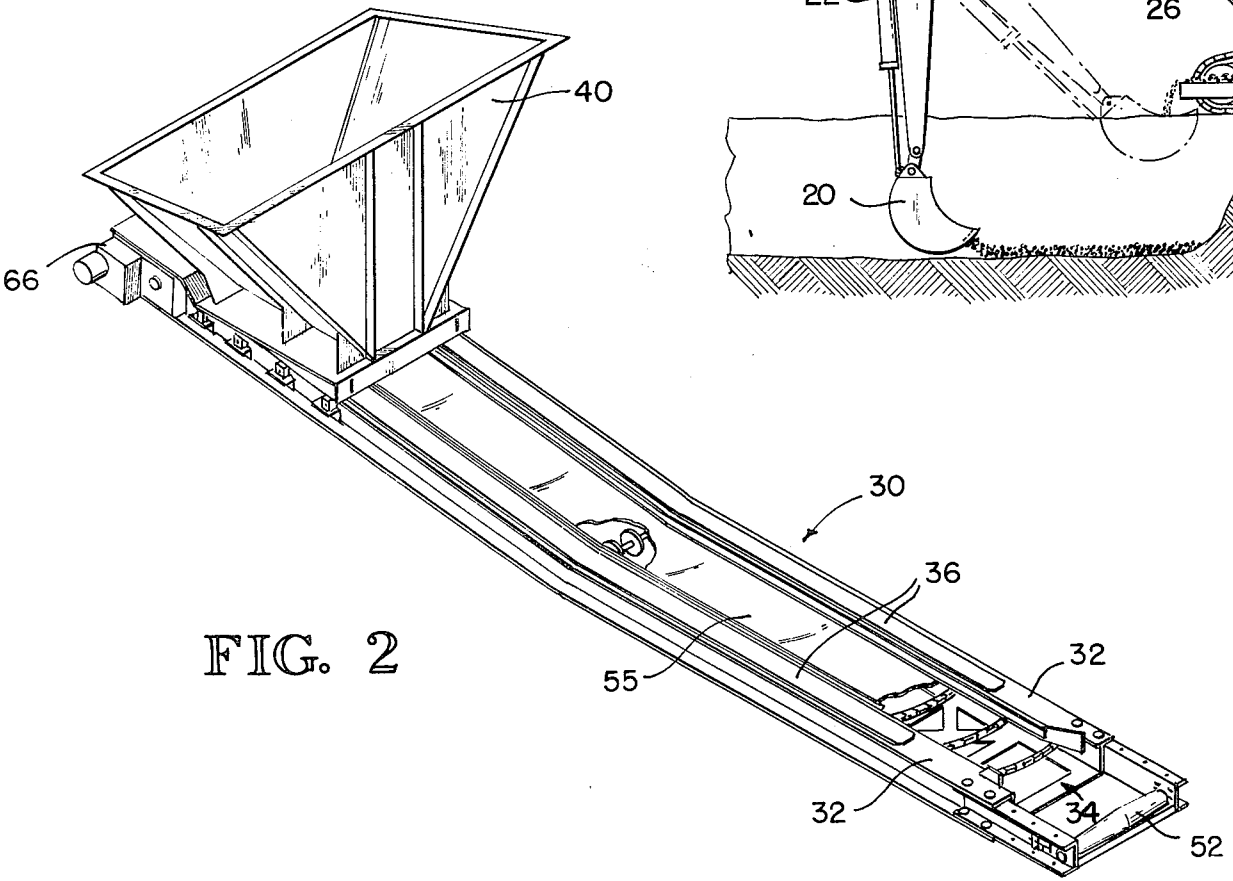
FIG. 2 is a perspective view of the conveyor assembly prior to being connected to the backhoe of FIG. 1.

At the opposite end of the conveyor is a drive pulley 62 which is keyed to shaft 64. The drive pulley is covered with a coating of a traction material, such as a rubber coating which is riveted to the surface of the pulley. Referring to FIG. 2, a gear reducer 66 is connected to shaft 64. The shaft 64 extends through openings in the I-beams 32 and is journaled for rotation to flange block bearings 68. An idler roll 70 is mounted adjacent the drive pulley 62, the idler roll shaft extending through openings in the I-beams 32 and flange block bearings 72. Both the drive pulley 62 and tensioning idler roll 70 can be adjusted horizontally by means of the threaded shaft 74 which extends through threaded flanges 76 secured to the I-beam 32, the one end of the shaft 74 secured to a plate 78 supporting the flange block bearings 72 and 68.

The conveyor belt 55, such as a two-ply rubber belt, is trained about the front pulley 52, along the top of the idle rolls 42 and 48, and around the drive pulley 62. Referring to FIG. 4, an L-shaped flange 80 is welded to the inner part of I-beams 32 as illustrated. Pieces of rubber flashing 82 are secured to the L-shaped member by means of a bar 84, the rubber flashing contacting the upper surface of the belt 55 along the length of the conveyor path. The flashing serves to channel the material being conveyed along the conveyor pathway to the discharge end. Where the alternative method of adjusting the length of the conveyor is used, as described on page 4, the gap between the piece of the main frame supporting the pulley 52 and the end of the main frame is filled by a plate which is secured to the top of the parallel supports, the plate also including flashing.

A hydraulic motor 86 (see FIG. 6) mounted to the case of the gear reducer 66 provides power through the gear reducer to drive shaft 64. The motor is suitably a hydraulic motor driven from power taken from the backhoe unit. A control mechanism is provided in the cab of the backhoe unit to allow the operator of the backhoe to start and stop the conveyor motor on command.

At the rear of the conveyor is mounted a hopper 40 having a discharge opening at its lower end.

In operation, the hopper 40 is loaded with bedding or other material with a front end loader or other suitable means. When bedding is needed, the operator of the backhoe moves the bucket of the backhoe to the position shown in phantom in FIG. 1 and activates the hydraulic motor driving the conveyor belt 55, which moves material from the hopper along the conveyor to the discharge end, where it falls directly into the bucket. Once the bucket is filled, the operator stops the conveyor 55 and spreads the material where desired. The hopper is refilled as needed. The conveyor assembly allows faster and more convenient operation, eliminates spillage of material being conveyed, and enables the backhoe to work in tight spaces where the turret of the backhoe cannot be rotated.

We claim:

1. A backhoe excavator having articulated arms, with a bucket mounted on the end of one such arm, the excavator modified to convey bedding material from the rear of the excavator to the front thereof for discharge into the bottom of a trench dug by the excavator without having to rotate the turret and the articulating arms of the excavator from the position used to dig the trench, comprising:

a backhoe excavator, including an undercarriage supported on spaced, parallel crawler tracks, a turret rotatably mounted to the undercarriage, and a pair of articulating arms secured to the front end of the turret of the excavator, the arms including a first arm pivotally secured at one of its ends to the turret and at the other end to a second arm, the second arm pivotally secured at one end to the first arm and having a bucket secured to the other end thereof;

a conveyor assembly including a conveyor belt secured in a fixed, non-pivotable position to the undercarriage of the excavator so that the travel path of the conveyor extends longitudinally of the crawler tracks of the excavator and substantially parallel to the ground on which the excavator rests beneath the turret and between and substantially parallel to the crawler tracks thereof, the infeed end of the conveyor assembly extending beyond the rear end of the excavator in a direction opposite the pair of articulating arms, and the discharge end of the conveyor assembly extending forwardly of the excavator and adjacent the pair of articulating arms;

a hopper mounted immediately adjacent the rear end of the backhoe excavator over the infeed end of the conveyor assembly, the hopper having a bottom discharge opening for discharging bedding material placed in the hopper directly onto the infeed end of the conveyor belt; and power means operatively connected to the conveyor belt to move bedding material from the infeed end of the belt to the discharge end thereof for discharging the bedding material into the trench.

2. The backhoe excavator of claim 1 wherein the conveyor assembly includes a conveyor frame having spaced support members, a plurality of idler rollers spaced along the length of the conveyor frame for supporting the conveyor belt, a drive pulley around which the conveyor belt is trained, and drive means secured to the drive pulley for driving the same.

3. The backhoe excavator of claim 2, including vertically oriented flashing defining sidewalls for the conveyor belt to direct the material being conveyed along the conveyor belt.

4. The backhoe excavator of claim 1 wherein the hopper has sidewalls whose top edges slope downwardly thereof from the front to the rear thereof.

5. A backhoe excavator having articulating arms with a bucket mounted on the end of one such arm, modified to convey bedding material from the rear end of the backhoe excavator to the front end thereof for discharge into the bottom of a trench dug by the excavator without having to rotate the turret of the excavator and the articulating arms from the position used to dig the trench, comprising:

a backhoe excavator, including an undercarriage supported on spaced parallel crawler tracks, a turret rotatably mounted to the undercarriage, and a pair of articulating arms secured to the front end of the turret, the arms including a first arm pivotally secured at one of its ends to the turret and at the other end to a second arm, the second arm pivotally secured at one end to the first arm and having a bucket secured to the other end thereof;

a support frame, including parallel support members secured in a fixed, non-pivotable position to the undercarriage of the excavator extending in a horizontal position substantially parallel to the ground on which the excavator rests and between the crawler tracks, the parallel supports extending from just beyond the front of the excavator adjacent the pair of articulating arms to beyond the rear thereof opposite the pair of articulating arms;

a plurality of idler rollers spaced along the length of the parallel support members and transverse thereto for supporting a conveyor belt;

a drive pulley extending between the support members at the infeed end of the conveyor assembly;

a pulley extending between the support members at the discharge end of the conveyor assembly;

a conveyor belt trained about the drive pulley at the infeed end and pulley at the discharge end and extending over the plurality of idler rollers;

a hopper mounted above the infeed end of the conveyor belt and immediately adjacent the rear end of the excavator opposite the pair of articulating arms having a bottom discharge opening positioned to discharge bedding material placed in the hopper directly into the infeed end of the conveyor belt; and power means operating the drive pulley for moving the conveyor belt and bedding material placed thereon from the infeed end to the discharge end of the conveyor assembly.

6. A method of providing bedding material in the bottom of a trench dug by a backhoe excavator having a pair of articulating arms, one arm having a bucket secured thereto, by conveying bedding material from the rear of the excavator opposite the pair of articulating arms to the front thereof adjacent the pair of articulating arms without having to rotate the turret and articulating arms of the excavator from the position used to dig the trench, comprising:

digging an elongated trench with the bucket of the articulating arms of the backhoe excavator, the excavator positioned adjacent the trench, with the bottom of the trench being at a lower level than the ground on which the excavator is resting;

providing a bedding material conveyor whose travel path extends substantially parallel to the trench being dug, longitudinally of the excavator and between the crawler tracks and beneath the turret thereof for conveying bedding material from the rear of the excavator to the front end thereof adjacent the pair of articulating arms for discharge into the trench;

providing a hopper mounted above the infeed end of the conveyor immediately adjacent the rear end of the excavator and opposite the articulating arms of the excavator for holding bedding material to be discharged;

filling the hopper with bedding material to be conveyed without use of the bucket and articulating arms of the backhoe excavator;

moving the conveyor belt with bedding material to be discharged supported thereon from the hopper to the discharge end of the conveyor belt where it falls into the trench; and spreading the bedding material along the bottom of the trench.

7. The method of claim 6 including moving the conveyor belt with bedding material to be discharged supported thereon from the hopper to the discharge end of the conveyor belt where it falls into the bucket of the excavator, and moving the excavator bucket to discharge the bedding material into the trench.

8. The method of claim 7 including stopping the conveyor belt when the bucket of the excavator is filled with the desired amount of bedding material for laying in the trench.

* * * * *